US007743714B2

(12) United States Patent
Nedelik

(10) Patent No.: US 7,743,714 B2
(45) Date of Patent: Jun. 29, 2010

(54) RAIL VEHICLE WITH IMPACT-ABSORBING POSTS

(75) Inventor: Robert Nedelik, Vienna (AT)

(73) Assignee: Siemens Aktiengesellschaft Osterreich, Vienna (AT)

( * ) Notice: Subject to any disclaimer, the term of this patent is extended or adjusted under 35 U.S.C. 154(b) by 247 days.

(21) Appl. No.: 11/787,466

(22) Filed: Apr. 17, 2007

(65) Prior Publication Data

US 2007/0214996 A1 Sep. 20, 2007

(51) Int. Cl.
*B61D 15/06* (2006.01)

(52) U.S. Cl. ..... 105/392.5; 296/193.06

(58) Field of Classification Search ..... 105/392.5; 296/193.06, 187.03, 187.12, 187.08, 202
See application file for complete search history.

(56) References Cited

U.S. PATENT DOCUMENTS

| | | | | |
|---|---|---|---|---|
| 4,715,292 | A * | 12/1987 | Pavlick et al. | 105/456 |
| 6,158,356 | A * | 12/2000 | Hachet et al. | 105/392.5 |
| 6,263,805 | B1 * | 7/2001 | Taguchi et al. | 105/421 |
| 6,688,237 | B2 * | 2/2004 | Back et al. | 105/392.5 |
| 2003/0056683 | A1 | 3/2003 | Yamaguchi et al. | |
| 2004/0159261 | A1 * | 8/2004 | Steele | 102/477 |
| 2004/0159263 | A1 * | 8/2004 | Yamamoto et al. | 105/392.5 |
| 2007/0214996 | A1 * | 9/2007 | Nedelik | 105/238.1 |
| 2007/0261591 | A1 * | 11/2007 | Bravo et al. | 105/392.5 |
| 2008/0314282 | A1 * | 12/2008 | Malfent et al. | 105/392.5 |

FOREIGN PATENT DOCUMENTS

WO WO 2005 085032 A 9/2005

OTHER PUBLICATIONS

International Search Report, PCT/AT2005/000404, dated Jan. 20, 2006 (7 pages).
Written Opinion, PCT/AT2005/000404, dated Jan. 20, 2006 (5 pages) (2 pages translation).
Glasers Annalen, Georg Siemens Verlag, Berlin, Germany, "Crashworthy Rail Vehicle—Recommendations for Manufacturers and Operators"; Wolter; vol. 128, Jun. 2004, pp. 196-206. **Abstract of translation only.
First Office Action, Austrian Patent Office, dated Apr. 23, 2007 A 1757/2004; (3 pages) (1 page translation).

* cited by examiner

*Primary Examiner*—S. Joseph Morano
*Assistant Examiner*—Jason C Smith
(74) *Attorney, Agent, or Firm*—Anton P. Ness; Fox Rothschild LLP

(57) ABSTRACT

A rail vehicle with at least two impact-absorbing posts (RS1, RS2) which are disposed in a front end region (END) and extend vertically to the floor (BOD) of the rail vehicle. A deformable area (KZO) is provided on the front side of the floor (BOD) and each impact-absorbing post (RS1, RS2) is connected to the roof section (DAB) of the rail vehicle via the upper-end region (OE1, OE2) thereof, each impact-absorbing post having, in the respective upper-end region thereof, a pre-determined collapsible region (OE1, OE2) where the buckling (SK1, SK2) of said post should occur in the event of a collision.

5 Claims, 4 Drawing Sheets

RAIL VEHICLE WITH IMPACT-ABSORBING POSTS

CROSS-REFERENCE TO RELATED APPLICATIONS

This application claims priority from PCT Application No. PCT/AT04/000404 filed Oct. 10, 2005, which claims priority from Austrian Application No. A 1757/2004 filed Oct. 19, 2004.

FIELD OF THE INVENTION

The present invention relates to the field of railway vehicles and more particularly to rail vehicles with impact-absorbing capabilities.

BACKGROUND OF THE INVENTION

The invention relates to a railroad vehicle with at least two collision posts disposed in an end region of the railroad vehicle and extending perpendicularly to a floor of the railroad vehicle, wherein a crumple zone is disposed in a front end region of the floor and each of the collision posts is connected at its upper end to a roof region of the railroad vehicle, each of the collision posts being provided with a buckling knuckle in its upper end region.

The front end region of a railroad vehicle must bear strong forces without being permanently deformed and to this end it is generally constructed with appropriate rigidity. In the event of a collision, however, a crumple zone in the end region of the railroad car must be capable of undergoing a defined degree of deformation. An example of a railroad vehicle having an end crumple zone is disclosed in DE 199 56 856 A1. The rigidity of the front part, however, must not hinder the deformation of the crumple zone in the event of a collision. At this juncture it should be noted that the region of a railroad vehicle that is deformed and thus absorbs energy is generally designated as a crumple zone. In a collision of two railroad vehicles, the crumple zone must absorb a large part of the released energy through plastic deformation, but in order to function correctly, the crumple zone must not tilt up during the deformation process. The floor region in the vehicle end zone must therefore remain level despite the deformation of the crumple zone.

Furthermore, to prevent the crumple zone of a railroad vehicle from tilting upwardly during deformation thereof, disclosures in EP-A 1,295,772 and the article by Wolter. W. "*Kollisionssi-chere Schienenfahrzeuge—Empfehlungen fur Hersteller und Betreiber* (*Crashworthy Rail Vehicle—Recommendations for Manufacturers and Operators*)" Glasers Annalen, Georg Siemens Verlag, Berlin, DE, Vol. 128, June 2004 (2004-06), pages 196 to 206, XP001196844 ISSN-1618-8330, reveal that each collision post has a buckling region in its upper end region.

A buckling region is to be understood here as being a region that has a weaker construction than the rest of the collision post, such that the collision post buckles in the region of the buckling site in the event of a major stress, such as when there is a collision thereof with another railroad vehicle. By means of this solution, the collision post is buckled in the buckling region in the event of a deformation of the crumple zone, in which case, a knuckle is formed in the buckling region, and the floor region or the crumple zone is guided by the collision posts. An upward tilt of the crumple zone or the front end floor region is prevented by the guidance provided by the collision posts. Thus the structure of the front part, namely the collision posts, stabilizes the deformation of the crumple zone in the event of a collision.

BRIEF SUMMARY OF THE INVENTION

It is an object of the invention to improve a railroad vehicle of the type described above in that guidance of the crumple zone during deformation can be achieved very easily in a railroad car by using an end door, wherein the collision posts are designed as door posts of a door opening.

In another object of the invention, and in a very readily achievable embodiment of the invention, the buckling region of a collision post is realized by means of at least one slot shaped recess in the collision post. According to an advantageous development, each collision post can have two slot-shaped recesses disposed parallel to each other on that side of said collision post which faces the associated railroad vehicle body.

BRIEF DESCRIPTION OF THE DRAWINGS

The accompanying drawings, which are incorporated herein and constitute part of this specification, illustrate the presently preferred but non-limiting embodiments of the invention, and, together with the general description given above and the detailed description given below, serve to explain the features of the invention. In the drawings.

DETAILED DESCRIPTION OF THE INVENTION

Figure 1:
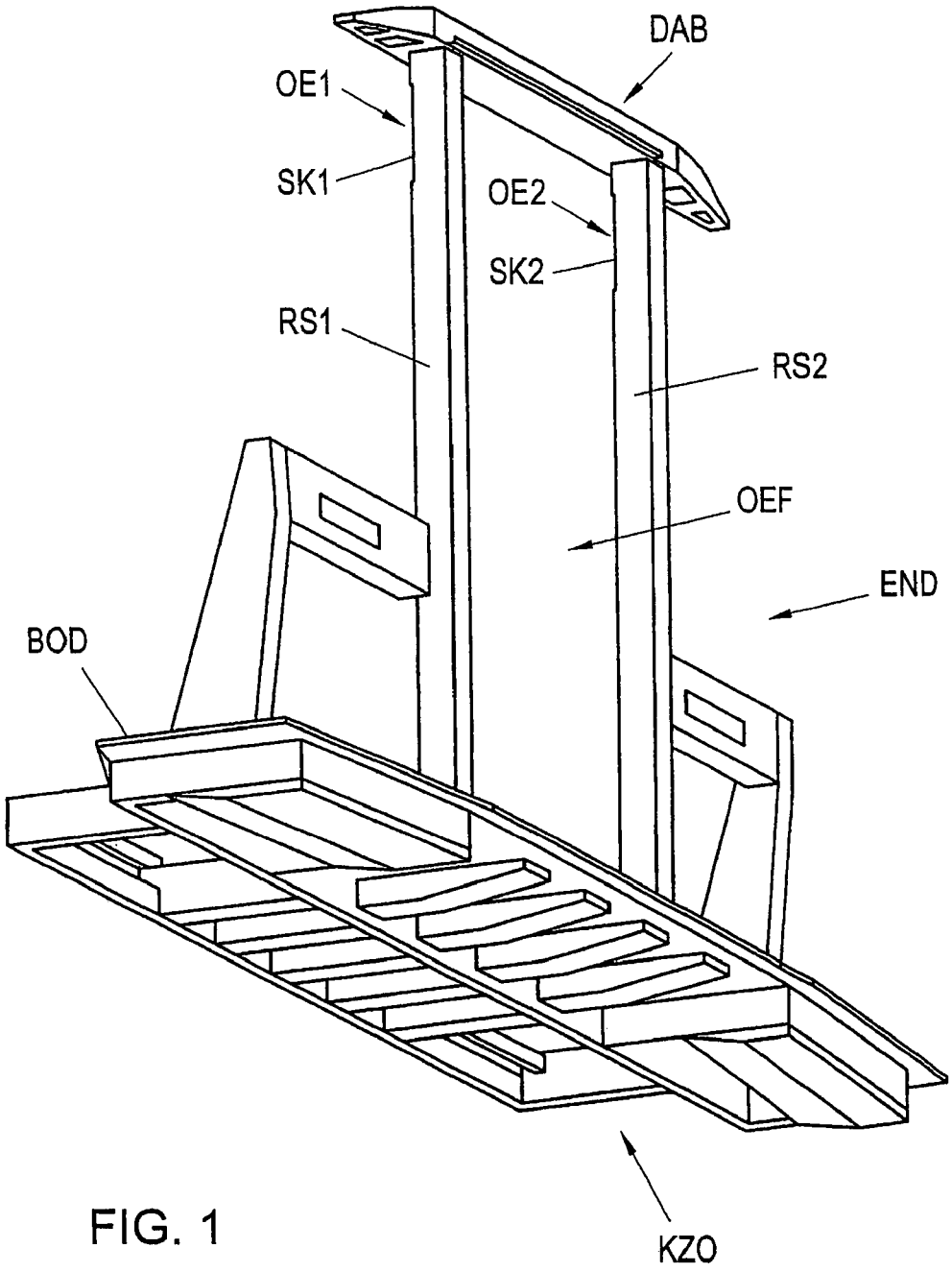
FIG. 1 is a diagrammatic perspective view of a front end section of a railroad vehicle of the invention in an undeformed condition.
Figure 2:
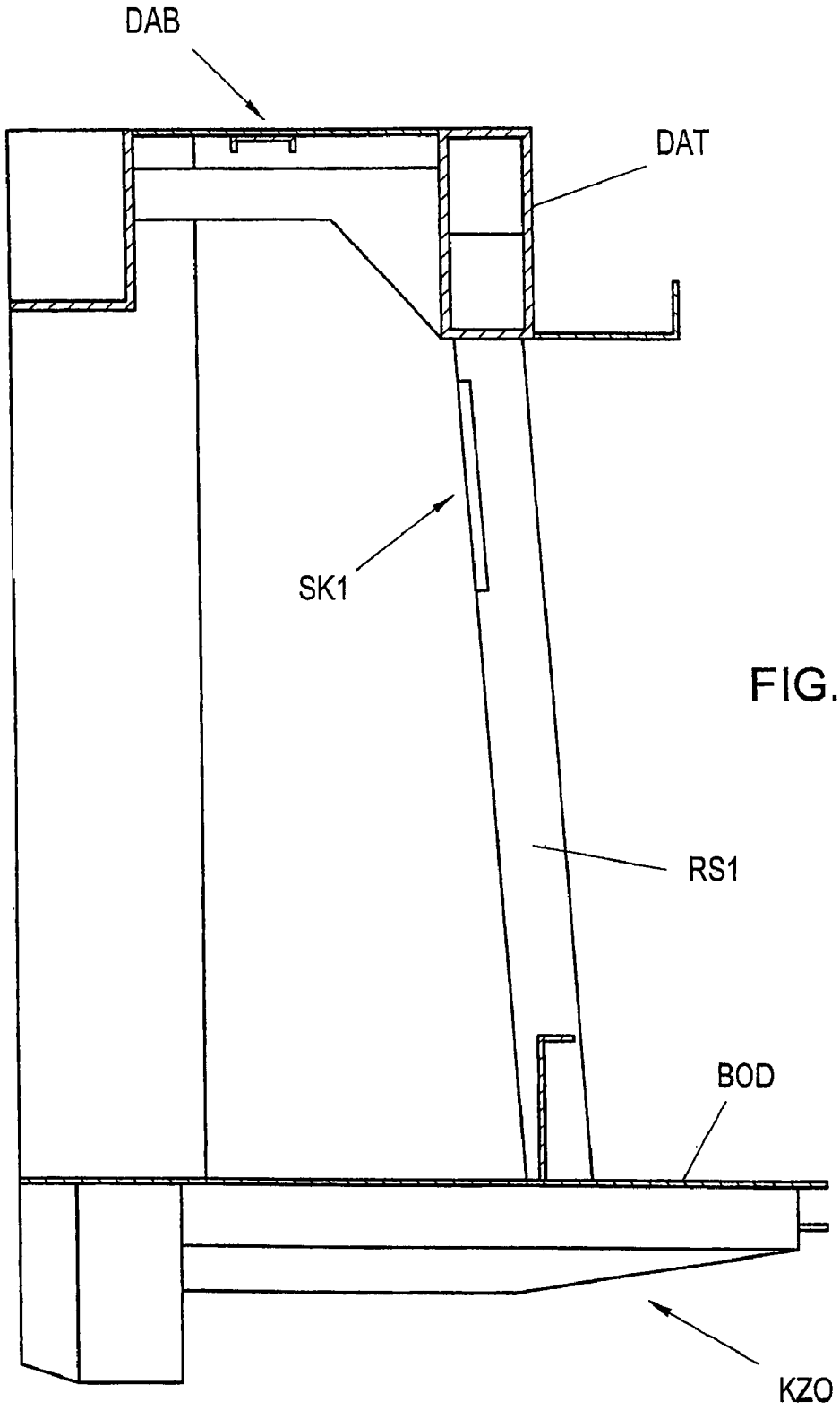
FIG. 2 is a partially cutaway diagrammatic side view of the end section illustrated in FIG. 1.

According to FIG. 1, a railroad vehicle of the invention has two impact-absorbing or collision posts RS1, RS2 in a front end region END. The collision posts RS1, RS2 can be manufactured from, say, steel or aluminum. Both of the collision posts RS1, RS2 are connected at their lower ends to a floor BOD or a crumple zone KZO of the railroad vehicle. At their upper end regions OE1, OE2, the collision posts RS1, RS2 are each connected to a roof region DAB, for example to a roof cross beam DAT, of the railroad vehicle (FIG. 2). The connection of the collision posts RS1, RS2 to the crumple zone KZO is achieved in a manner known per se, for example by welding and/or by the use of plug-in or bolted connections, and therefore requires no further explanation in any great detail here.

Preference is given to a configuration of the collision posts RS1, RS2 as door posts of a front end door opening OEF.

In its upper end region OE1, OE2, each collision post RS1, RS2 has a buckling region SK1, SK2 in which the collision post RS1, RS2 is weakened. In the buckling regions SK1, SK2, the collision posts RS1, RS2 are buckled in the direction of a deformation force F when the crumple zone KZO is impacted (FIG. 3).

Figure 3:
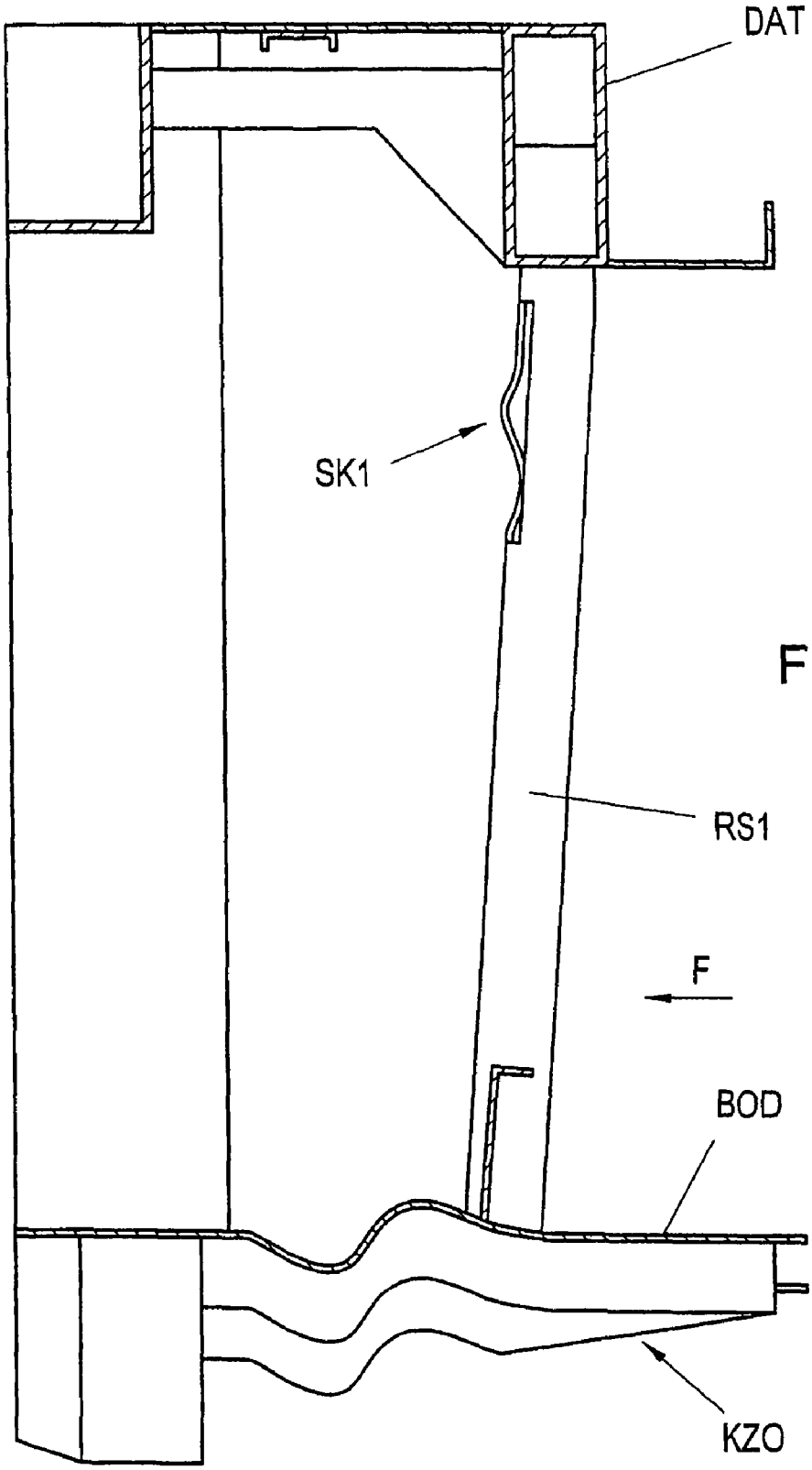
FIG. 3 is a cutaway diagrammatic side view of the section illustrated FIG. 1 in a deformed condition.

According to FIG. 3, a knuckle is formed on the collision post RS1 when the latter is buckled in the direction of the deformation force F. By means of this knuckle, the collision post RS1 is capable of following the deformation of the crumple zone KZO in the direction of deformation.

The rigidity of the collision posts RS1, RS2 in their longitudinal directions prevents the crumple zone KZO from tilting up. In the event of a deformation of the crumple zone KZO, the crumple zone KZO is guided by the collision posts RS1, RS2, thereby achieving stabilization of the floor region BOD during the deformation of the crumple zone KZO.

Figure 4:
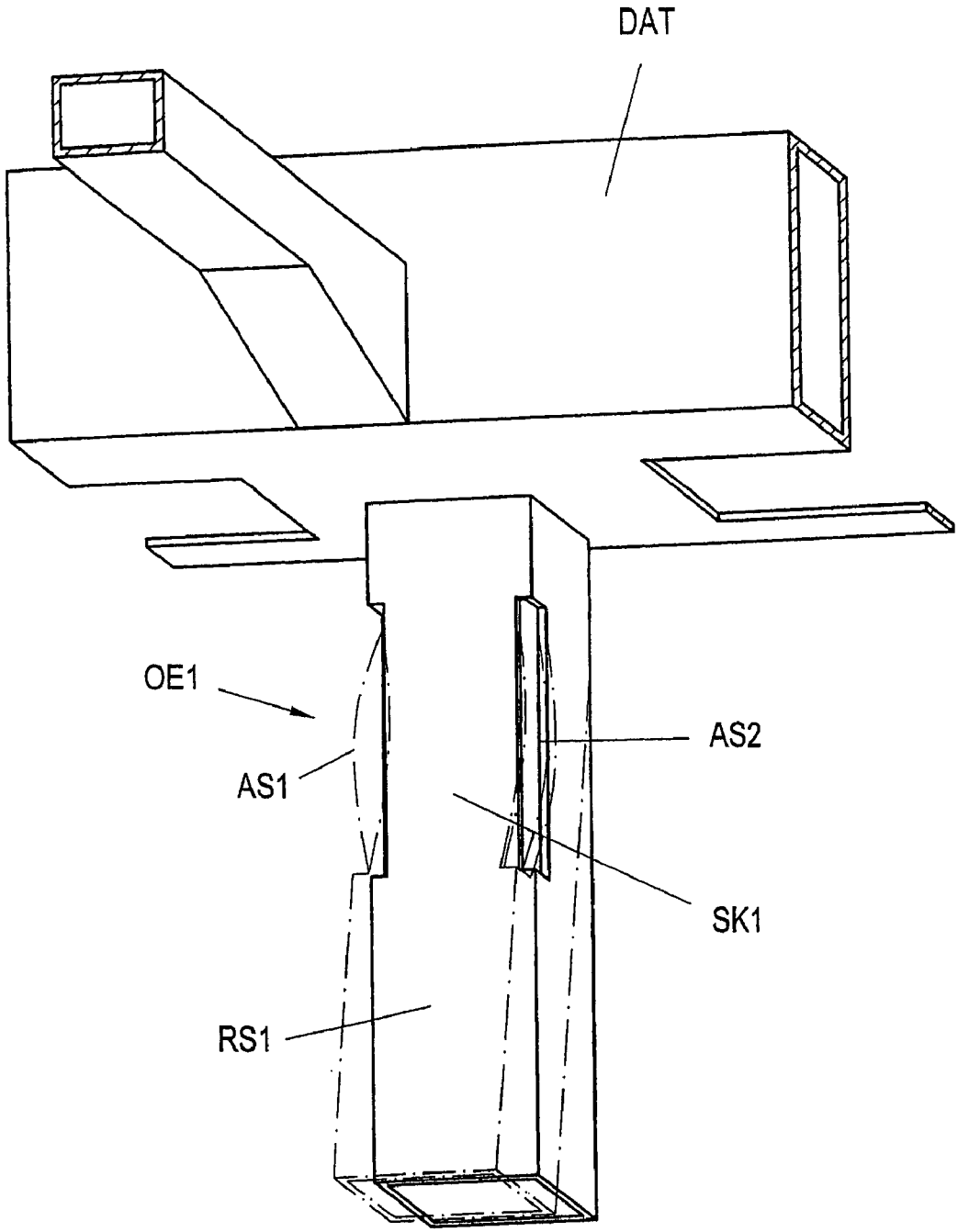
FIG. 4 is a partially cutaway diagrammatic perspective view of an upper end region of a collision post of a railroad vehicle of the invention.

As represented in FIG. 4, the buckling region SK1 can be formed by two recesses AS1, AS2 running parallel to each other on the collision post RS1. Only the upper end region OE1 of the collision post RS1 is represented in FIG. 4 but the upper end region OE2 of the collision post RS2 is configured in the same manner. The vertical longitudinal extension of the recesses AS1, AS2 runs parallel to the vertical longitudinal extension of the collision post RS1. The recesses AS1, AS2 are disposed on that side of the collision post RS1 which faces a railroad vehicle body (not shown) and they are dimensioned such that the collision post RS1 is capable of withstanding the required static stresses, while in the event of a collision, instability of the post profile arises in the buckling region SK1, with the result that the collision post RS1 buckles.

The collision posts RS1, RS2 can be replaced along with the crumple zone KZO following deformation of the latter.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A railroad vehicle comprising:

at least two collision posts disposed in an end region of the railroad vehicle and extending perpendicularly to a floor of the railroad vehicle, wherein a crumple zone is located at a front end region of the floor and each of the collision posts is connected at its upper end region to a roof region of the railroad vehicle, wherein each of the collision posts has a buckling region in its upper end region where each post is adapted to buckle upon collision by having thereat a construction weaker than remaining portions of the post, and wherein the collision posts are configured as door posts of a door opening.

2. A railroad vehicle as defined in claim 1, wherein the buckling region of a collision post is realized by means of at least one slot-shaped recess in the collision post.

3. A railroad vehicle as defined in claim 2, wherein each of the collision posts has two slot-shaped recesses extending parallel to each other on that side thereof which faces a body of the railroad vehicle.

4. A railroad vehicle comprising;

at least two collision posts disposed in an end region of the railroad vehicle and extending perpendicularly to a floor of the railroad vehicle, wherein a crumple zone is located at a front end region of the floor and each of the collision posts is connected at its upper end region to a roof region of the railroad vehicle, and wherein each of the collision posts has a buckling region in its upper end region where each post is adapted to buckle upon collision by having thereat a construction weaker than remaining portions of the post, and wherein the buckling region of a collision post is realized by means of at least one slot-shaped recess in the collision post.

5. A railroad vehicle as defined in claim 4, wherein each of the collision posts has two slot-shaped recesses extending parallel to each other on that side thereof which faces a body of the railroad vehicle.

* * * * *